US005410341A

United States Patent [19]

Sugahara et al.

[11] Patent Number: 5,410,341

[45] Date of Patent: Apr. 25, 1995

[54] DROPLET JET DEVICE

[75] Inventors: Hiroto Sugahara, Aichi; Masahiko Suzuki, Nagoya; Yoshikazu Takahashi, Kasugai, all of Japan

[73] Assignee: Brother Kogyo Kabushiki Kaisha, Nagoya, Japan

[21] Appl. No.: 848,695

[22] Filed: Mar. 9, 1992

[30] Foreign Application Priority Data

May 28, 1991 [JP] Japan ..... 3-123765
May 28, 1991 [JP] Japan ..... 3-123776
May 31, 1991 [JP] Japan ..... 3-129442

[51] Int. Cl.[6] ..... B41J 2/045
[52] U.S. Cl. ..... 347/69
[58] Field of Search ..... 346/140 R; 310/333; 347/68, 69, 71; B41J 2/045

[56] References Cited

U.S. PATENT DOCUMENTS 4,367,480 1/1983 Kotoh ..... 346/140 R
4,752,788 6/1988 Yasuhara et al. ..... 346/140 R
4,842,493 6/1989 Nilsson ..... 346/140 R X
4,879,568 11/1989 Bartky et al. ..... 346/140 R
4,887,100 12/1989 Michaelis et al. ..... 346/140 R
4,916,468 4/1990 Hayamizu ..... 346/140 R
4,940,996 7/1990 Paton et al. ..... 346/140 R
4,942,409 7/1990 Paton et al. ..... 346/140 R
4,949,256 5/1990 Sheperd ..... 51/293
4,973,981 11/1990 Bartky et al. ..... 346/1.1
5,016,028 5/1991 Temple ..... 346/140 R
5,144,342 9/1992 Kubota ..... 346/140 R
5,252,994 10/1993 Narita et al. ..... 346/140 R
5,260,723 11/1993 Naruse et al. ..... 346/140 R

FOREIGN PATENT DOCUMENTS

0417673A2 3/1991 European Pat. Off. .
3820082A1 12/1988 Germany .
59-187868 10/1984 Japan ..... 346/140 R

*Primary Examiner*—Benjamin R. Fuller
*Assistant Examiner*—Alrick Bobb
*Attorney, Agent, or Firm*—Oliff & Berridge

[57] ABSTRACT

A droplet jet device for use in an ink jet printer. The device has a bottom ceramics plate into which parallel grooves for storing ink are cut. A covering plate is either fixedly or slidably mounted over the grooved side of the ceramic plate to enclose the grooves. The sidewalls of the grooves have electrodes mounted thereon. One end of each groove is connected to an opening serving as an ink jet and the other end is connected to a ink source. The ink jets may be smaller grooves connecting the grooves to a print face of the bottom ceramics plate or may be ends of smaller grooves in the cover plate, one of the smaller grooves in the cover plate partially overlapping a corresponding groove in the ceramics base plate. When a current is applied to selected electrodes, the associated walls are deformed by a piezoelectric effect to compress the groove and eject an ink droplet from the ink jet.

11 Claims, 8 Drawing Sheets

DROPLET JET DEVICE

BACKGROUND OF THE INVENTION

1. Field of the Invention

The invention relates to a droplet jet device and, more particularly, to a construction of a jet nozzle in a droplet jet device.

2. Description of the Related Art

There is conventionally proposed an ink jet printer of a bubble jet type using an electro-heat transducer element as a pressure generating member or a piezoelectric type using an electro-mechanical transducer element as a pressure generating member. Such ink jet printers have received consumer notice because of their low noise as compared with impact type printers.

A piezoelectric type ink jet printer is called a drop on-demand system because the volume of an ink channel is changed by a change in dimension of a piezoelectric actuator. When the volume of the ink channel is decreased, ink in the ink channel is jetted from a jet nozzle, whereas when the volume of the ink channel is increased, ink is introduced through a valve into the ink channel. A plurality of such jet units are arranged close to one another and the ink is jetted from desired ones of the jet units to form characters and images on a recording medium such as a paper.

This type of droplet jet device is described, for example, in U.S. Pat. No. 4,879,568 and U.S. Pat. No. 4,887,100. FIGS. 10 and 11 schematically show a conventional droplet jet device. FIG. 10 is a sectional view of a part of an array 61 constituting the droplet jet device, a piezoelectric ceramics plate 62, polarized in a direction of arrow 51, has a plurality of side walls such as 63A, 63B, 63C, 63D and 63E. The piezoelectric ceramics plate 62 is bonded, through a bonding layer 67, to a cover plate 66 formed of a metal, glass or ceramics. With this construction, a plurality of ink channels, such as 64A, 64B, 64C and 64D are so formed as to be spaced from one another in a lateral direction as shown in FIG. 10. Each ink channel 64 is elongated along each side wall 63 and has a rectangular cross section. Each side wall 63 extends over a full length of each ink channel 64 and is deformable in the direction perpendicular to an axis of each ink channel 64 and the polarizing direction 51 to change an ink pressure supplied in the ink channel 64. A metal electrode 65, for applying a driving electric field to the side wall 63, is formed on a surface of each side wall 63. The metal electrode 65 is surface-treated to prevent corrosion by the ink.

When the jet unit 64B in the array 61 is selected according to desired print data, for example, a driving electric field is applied between the metal electrodes 65A and 65B and between the metal electrodes 65C and 65D. As the driving electric field direction and the polarizing direction are perpendicular to each other, the side wall 63B and the side wall 63C are deformed in the internal direction of the ink channel 64B by a piezoelectric thickness slip effect. This deformation causes a decrease in volume of the ink channel 64B to increase the ink pressure in the ink channel 64B. Accordingly, an ink droplet in the ink channel 64B is jetted from a jet nozzle shown in FIG. 11. When the application of the driving electric field is stopped, the side walls 63B and 63C are returned to their original positions, before deformation, so that the ink pressure in the ink channel 64B is decreased and ink is supplied from an ink supply section (not shown) into the ink channel 64B.

The above-mentioned array 61 is manufactured by the following method. As shown in FIG. 11, the piezoelectric ceramics plate 62, polarized in the direction of an arrow 51, is grooved by grinding by rotation of a diamond cutting disk to form a plurality of parallel grooves 74 constituting the above-configured ink channels 64. The above-mentioned metal electrode 65 is formed on the surface of each groove 74 by sputtering. The cover plate 66 is bonded to an upper surface 73A of the piezoelectric ceramics plate 62 on the grooves 74 side. A nozzle plate 70 having a plurality of jet nozzles 71, which correspond to the end positions of the ink channels 74, is bonded to an end surface 73B of the piezoelectric ceramics plate 62 on the ink jet side. In the step of bonding the nozzle plate, epoxy adhesive is used and it is heated at 150° C. for a period of ½ through 1 hour to harden the epoxy adhesive. Further, when no printing is carried out, a cap 80, for preventing choking of the ink channels 74 due to drying of ink, is mounted on a front surface of the nozzle plate 70.

Accordingly, in the above mentioned conventional device, the number of parts and manufacturing steps is large, and choking of the ink channels upon bonding of the nozzle plate 70 by the epoxy adhesive often occurs. Further, a temperature of the piezoelectric transducer is increased in the step of bonding the nozzle plate, causing a deterioration in piezoelectric characteristics of the piezoelectric ceramics plate 62.

SUMMARY OF THE INVENTION

An object of the present invention is to provide a droplet jet device having a reduced number of parts and manufacturing steps by eliminating the nozzle plate.

Another object of the present invention is to provide a droplet jet device which can increase the yield, reduce manufacturing costs, and eliminate the choking of the ink channels.

A further object of the present invention is to provide a droplet jet device which can prevent a deterioration in piezoelectric characteristics of the piezoelectric transducer.

According to the present invention achieving the above objects, a droplet jet device having a plurality of jet units for jetting ink includes: a base plate having an end surface; at least a pair of side walls formed by a piezoelectric transducer and mounted on the base plate, the pair of side walls defining an ink channel having one end spaced from the end surface of the base plate; a cover plate mounted on the side walls; a jet nozzle formed on either the cover plate or the base plate, the jet nozzle communicating with the ink channel; electrodes formed on both side surfaces of the side walls; and a driving unit for applying voltage to the electrodes.

With this construction, when the pair of side walls are deformed by applying a driving electric field thereto, the volume of the ink channels corresponding to a desired one of the jet units is reduced, and the ink in the ink channel is jetted from the jet nozzle corresponding to the ink channel.

As apparent from the above description, according to the droplet jet device of the present invention, the jet nozzle can be formed without providing the nozzle plate so that the number of parts and bonding steps can be reduced. The reduced number of parts and bonding steps realize a reduction in manufacturing costs, and choking of the ink channels can be eliminated thereby realizing an improvement in yield.

Further, as no step of bonding the nozzle plate is required, a temperature increase of the piezoelectric transducer and a deterioration in piezoelectric characteristics of the piezoelectric transducer due to the temperature increase is eliminated.

BRIEF EXPLANATION OF THE DRAWINGS

The invention will be described with reference to the figures in which.

DETAILED DESCRIPTION OF THE PREFERRED EMBODIMENTS

A first preferred embodiment of the present invention will now be described with reference to FIGS. 1 through 4.

Figure 1:
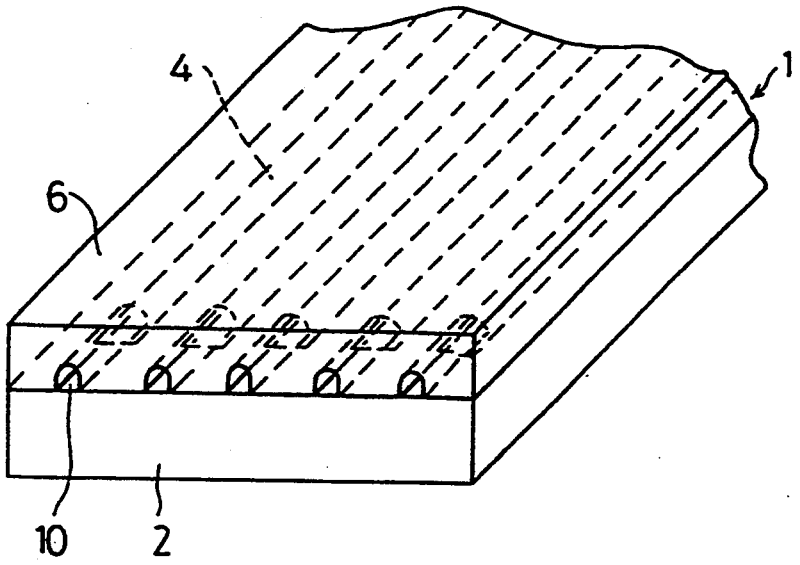
FIG. 1 is a perspective view of an array constituting a part of a droplet jet device according to a first preferred embodiment of the invention.

FIG. 1 is a partially cutaway perspective view of an array 1. The array 1 comprises a piezoelectric ceramics plate 2 as a piezoelectric transducer and a cover plate 6 bonded to an upper surface of the piezoelectric ceramics plate 2. Piezoelectric ceramics, piezoelectric resin such as polyvinylidene fluoride, or a mixture of piezoelectric ceramics and piezoelectric resin can be used as the piezoelectric transducer. The piezoelectric ceramics plate 2 has a plurality of ink channels 4 formed by a plurality of first grooves arranged in parallel. The cover plate 6 has a plurality of jet nozzles 10 formed by a plurality of second grooves arranged in parallel. The second grooves are formed in a one-to-one correspondence to the first grooves.

Figure 2:
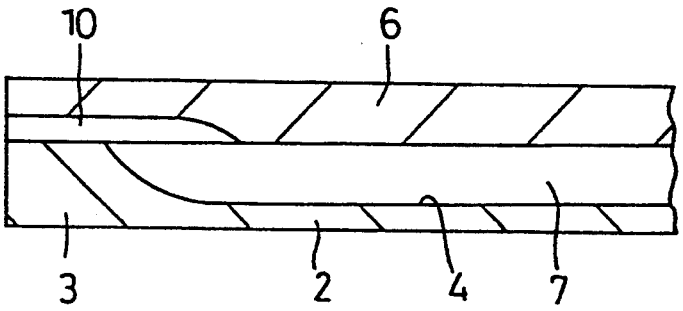
FIG. 2 is a vertical sectional view of a part of the array shown in FIG. 1.

As shown in FIG. 2, one end of each ink channel 4 is spaced by a predetermined distance from an end surface of the piezoelectric ceramics plate 2 on the ink jet side, that is, a non-groove portion 3 having the predetermined distance is left between the one end of each ink channel 4 and the end surface of the piezoelectric ceramics plate 2. Each jet nozzle 10 has a width smaller than that of each ink channel 4 and a length longer than that of each non-groove portion 3 in the direction of extension of each ink channel 4. Each ink channel 4 communicates, near its one end, with the corresponding jet nozzle 10. The other end of each ink channel 4 communicates with an ink supply section (not shown).

Figure 3:
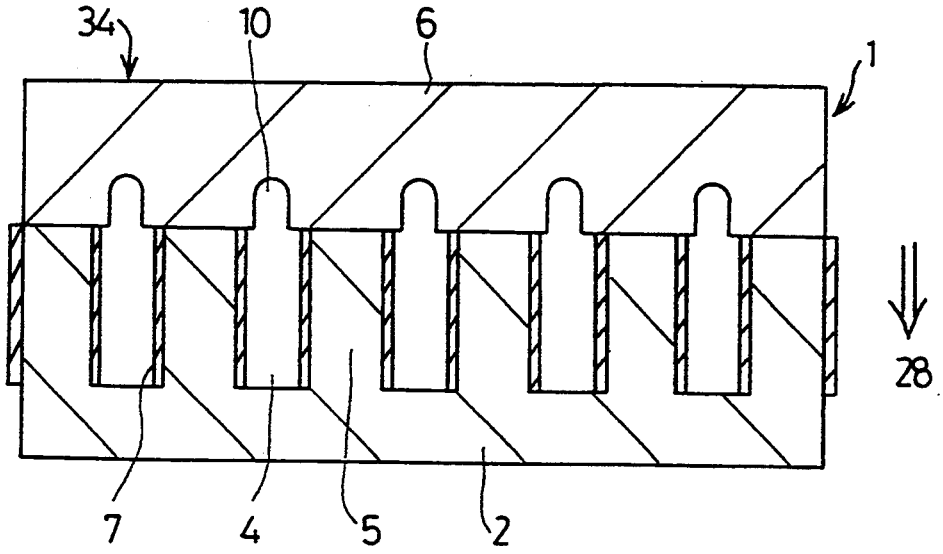
FIG. 3 is a sectional view of the array constituting a part of the droplet jet device.

FIG. 3 is a sectional view of the array 1 at the communicated portions between the ink channels 4 and the jet nozzles 10. As shown in FIG. 3, the piezoelectric ceramics plate 2 is polarized in the direction of an arrow 28. The ink channels 4 are formed of the first grooves arranged in parallel, each first groove having a width of 0.1 millimeter and a depth of 0.25 millimeter.

The piezoelectric ceramics plate 2 has a plurality of side walls 5 defining the ink channels 4, each side wall 5 having a width of 0.2 millimeter. The cover plate 6 has the jet nozzles 10 formed of the second grooves arranged in parallel, each second groove having a semi-oval shape in section and having a width of 0.04 millimeter and a depth of 0.06 millimeter.

The piezoelectric ceramics plate 2 is formed of a ceramics material having a ferroelectricity such as lead titanate zirconate (PZT), the plate 2 having a thickness of 0.4 millimeter. The first grooves constituting the ink channels 4 are formed on the piezoelectric ceramics plate 2 by grinding such as by rotation of a diamond cutting disk or by laser beam machining. A metal electrode 7 is formed on the side surface of each first groove. The surface of the metal electrode 7 which is facing the ink channel 4 is electrically insulated in order to avoid shorting the metal electrodes 7 by the ink in the ink channels 4. The cover plate 6 may be formed of the same material as that of the piezoelectric ceramics plate 2 or another material, such as borosilicate glass, different from the material of the plate 2. The cover plate 6 is not polarized and has a thickness of 0.2 millimeter. The second grooves constituting the jet nozzles 10 are formed on the cover plate 6 by grinding such as by rotation of a diamond cutting disk, laser beam machining, or etching. The cover plate 6 is bonded, using an epoxy resin or an adhesive having similar flexing properties, to the upper surface of the piezoelectric ceramics plate 2 so that the jet nozzles 10 are partially overlapped with the ink channels 4 in a one-to-one correspondence.

Figure 4:
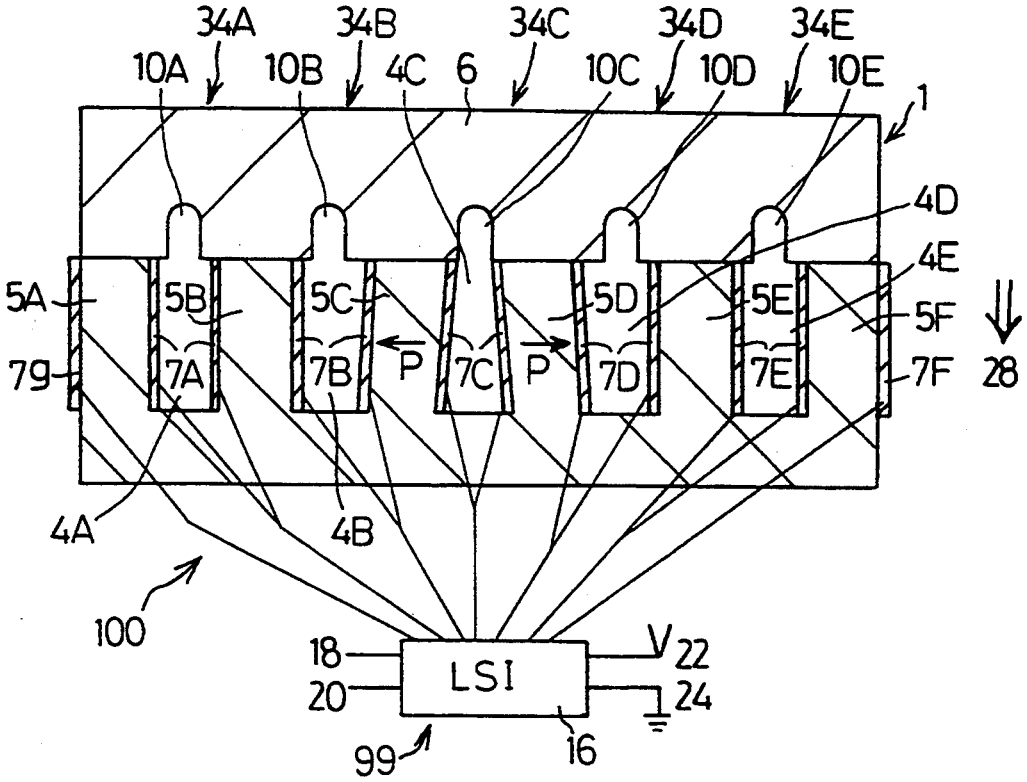
FIG. 4 is a sectional view illustrating a driving condition of the array by an electrical circuit.

A droplet jet device 100 comprises the array 1 and a driving circuit 99. As shown in FIG. 4, the driving circuit 99 includes an LSI chip 16 and a clock line 18, a data line 20, a voltage line 22 and an earth line 24 which are connected to the LSI chip 16. Electrodes 7A to 7G are also individually connected to the LSI chip 16. Ink channels 4A to 4E are classified into first and second groups not adjacent to each other: The first and second groups are sequentially driven by continuous clock pulses to be supplied from the clock line 18.

Which of the two groups, the first group or the second group, that is to be operated is determined by a multi-bit word data appearing in the data line 20. A voltage V is applied from the voltage line 22 to the appropriate electrodes 7A to 7G of the group selected by a circuit in the LSI chip 16. Side walls 5A to 5F, formed on the opposite sides of the ink channels 4A to 4E selected above, are deformed by a piezoelectric effect due to the applied voltage V. Thus, all the ink channels 4A to 4E in each group are made operable. The appropriate electrodes 7A to 7G of the other ink channels 4A to 4E of the group selected for operation that are not operated, are grounded. The appropriate electrodes 7A to 7G in the ink channels 4A to 4E in the other, non-operated, group are also grounded.

The operation of the above preferred embodiment will now be described with reference to FIG. 4 which illustrates the case where a jet unit 34C is selected according to desired print data. In this case, the voltage V is applied from the voltage line 22 to the electrodes 7C in the ink channel 4C. The other electrodes 7A, 7B, 7D, 7E, 7F and 7G are grounded. As the electric field is applied to the side walls 5C and 5D in the direction (depicted by arrows P) perpendicular to the polarizing direction 28, the side walls 5C and 5D are deformed into an inverted V-shape toward the ink channel 4C owing to the piezoelectric thickness slip effect, the deformation permitted by the flexible expoxy resin bond between the cover plate 6 and the side walls. Accordingly, a volume of the ink channel 4C is decreased to jet ink in the ink channel 4C from a jet nozzle 10C. When the application of the voltage is stopped, the side walls 5C and 5D return to their original positions, so that the volume of the ink channel 4C is increased to introduce ink from an ink supply section not shown. Similarly, when another jet unit, such as jet unit 34B is selected, the side walls 5B and 5C are deformed to jet ink in the ink channel 4B from the corresponding jet nozzle 10B.

The above-mentioned preferred embodiment is not limitative, but various modifications may be made without departing from the scope of the invention. For example, a second preferred embodiment of the present invention will now be described with reference to FIGS. 5 through 7, in which the same or corresponding parts as found in FIGS. 1 and 2 are denoted by the same reference numerals for the convenience of explanation.

Figure 5:
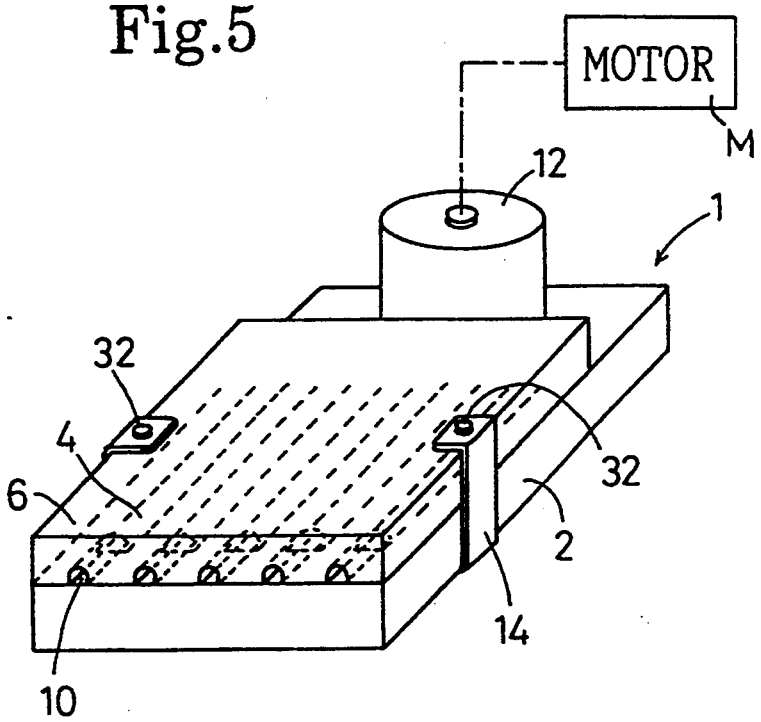
FIG. 5 is a perspective view of an array constituting a part of a droplet jet device according to a second preferred embodiment of the invention.

Referring to FIG. 5, which is a perspective view of an array 1, the array 1 is generally constructed of a piezoelectric ceramics plate 2 and a cover plate 6 bonded to an upper surface of the piezoelectric ceramics plate 2. The piezoelectric ceramics plate 2 has a plurality of ink channels 4 formed of a plurality of first grooves arranged in parallel. The cover plate 6 has a plurality of jet nozzles 10 formed of a plurality of second grooves arranged in parallel. The second grooves are formed in one-to-one correspondence to the first grooves. A pair of elastic springs 14 formed of rubber or the like are fixed at one end thereof to an upper surface of the cover plate 6 by pins 32 and fixed at the other end to a lower surface of the piezoelectric ceramics plate 2. A cam 12 is rotatably provided behind the cover plate 6. The cam 12 normally contacts a rear end surface of the cover plate 6 under the condition where a minor axis of the cam 12 is oriented in the longitudinal direction of the ink channels 4. The cam 12 is rotated by a motor M.

The basic construction and printing operation of the droplet jet device of the second preferred embodiment is substantially the same as that of the first preferred embodiment shown in FIGS. 1 through 4. Because this is so, a detailed explanation of that operation is omitted.

Figure 6:
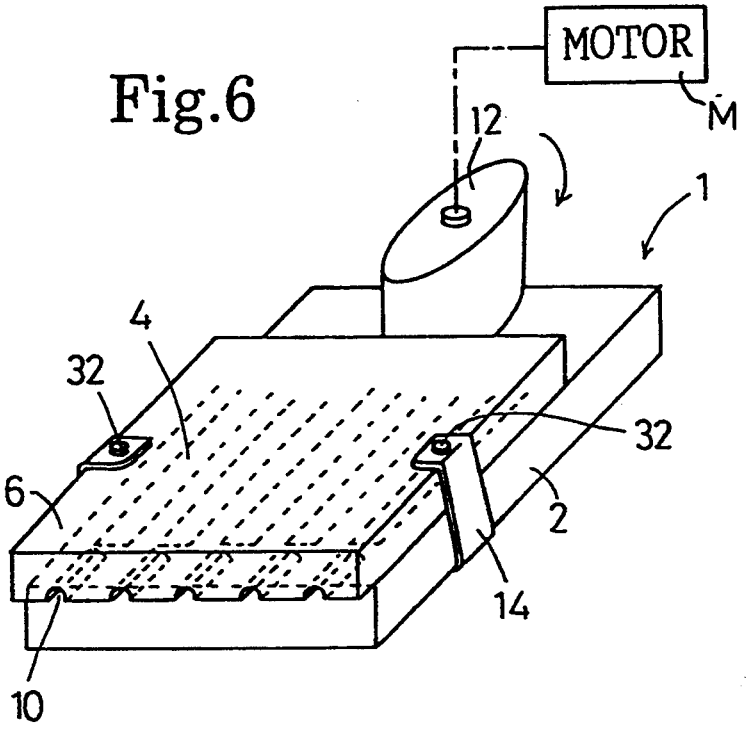
FIG. 6 is a perspective view similar to FIG. 5, illustrating a condition where the communication between ink channels and jet nozzles is cut off.
Figure 7:
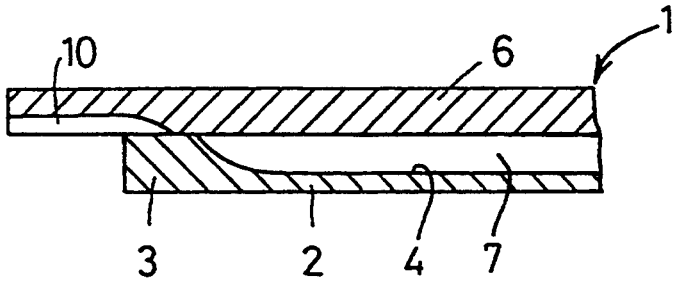
FIG. 7 is a vertical sectional view of a part of the array shown in FIG. 6.

However, in the array 1 comprising the droplet jet device of the second preferred embodiment, when no printing is carried out, the cam 12 is rotated to the position shown in FIG. 6 where a major axis of the cam 12 is oriented in the longitudinal direction of the ink channels 4. As a result, the cover plate 6 is urged by the cam 12 to slide forwardly in the longitudinal direction of the ink channels 4 by a distance more than a difference between the length of each second groove forming each jet nozzle 10 and the length of each non-groove portion 3 of the piezoelectric ceramics plate 2, that is, more than the distance the grooves forming jet nozzles 10 extend over the corresponding ink channels 4. At the same time, the elastic springs 14 are deformed in a shearing fashion to store elastic energy. In this condition, each jet nozzle 10 does not communicate with its corresponding ink channel 4 as shown in FIG. 7, thereby cutting the contact of the ink in the ink channels 4 with the outside air to prevent drying of the ink. When printing is carried out, the cam 12 is rotated to its original position, the elastic springs 14 release the elastic energy stored therein by returning to their original form. Accordingly, the cover plate 6 is returned to its original position shown in FIG. 5 to bring the jet nozzles 10 into communication with the corresponding ink channels 4.

Figure 11:
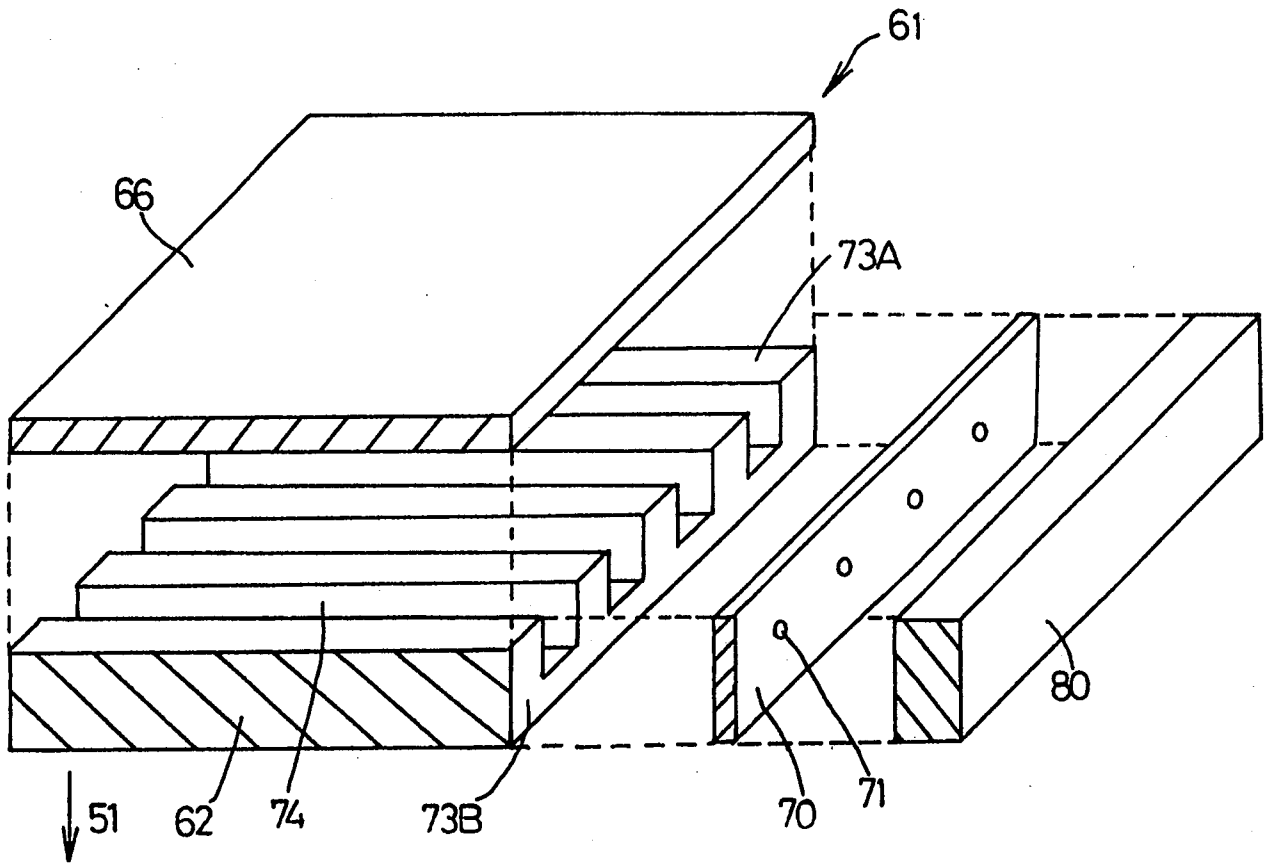
Fig.11 RELATED ART
FIG. 11 is a perspective view illustrating a manufacturing method of an array constituting a part of the droplet jet device in the related art.

As compared with the conventional droplet jet device shown in FIG. 11, the droplet jet device according to the invention does not require the nozzle plate 70 having the jet nozzles 71 and the cap 80. Accordingly, the number of parts and bonding steps can be reduced to thereby reduce the manufacturing costs. Further, choking of the ink channels often occurred in the bonding step producing a non-printing condition for those channels. That problem is eliminated to thereby improve the print and reliability.

It is to be noted that the above second preferred embodiment is also not limitative, but various modifications may be made without departing from the scope of the invention. For example, the plate having the ink channels may be formed of a non-piezoelectric material and the cover plate having the jet nozzles may be formed of piezoelectric ceramics adapted to be formed by a vertical piezoelectric effect. Further, an electroheat transducer element may be used as the pressure generating member. Likewise, the sliding direction of the cover plate relative to the piezoelectric ceramics plate is not limited to the longitudinal direction of the ink channels, but it may be the direction perpendicular to the longitudinal direction of the ink channels. The relative sliding direction is optional as the functionality it provides is what is important, that is the contact between the ink and the outside air may be cut off.

Additional preferred embodiments of the invention will be described with reference to FIGS. 8 and 9.

Figure 8:
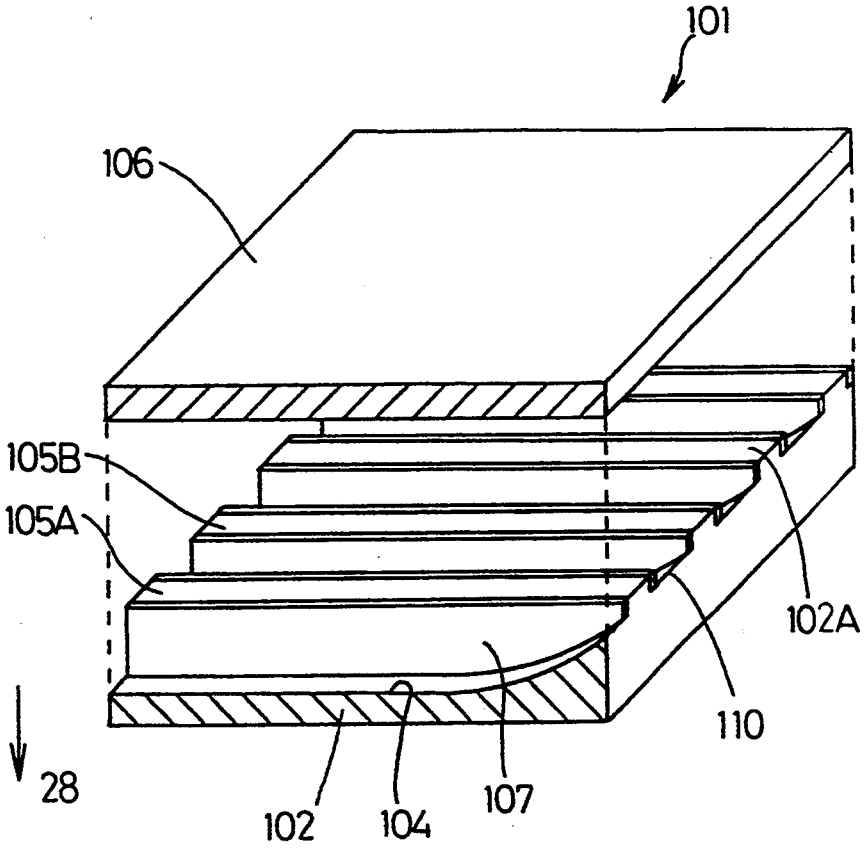
FIG. 8 is a perspective view illustrating a manufacturing method for an array constituting a part of a droplet jet device according to a third preferred embodiment of the invention.
Figure 9:
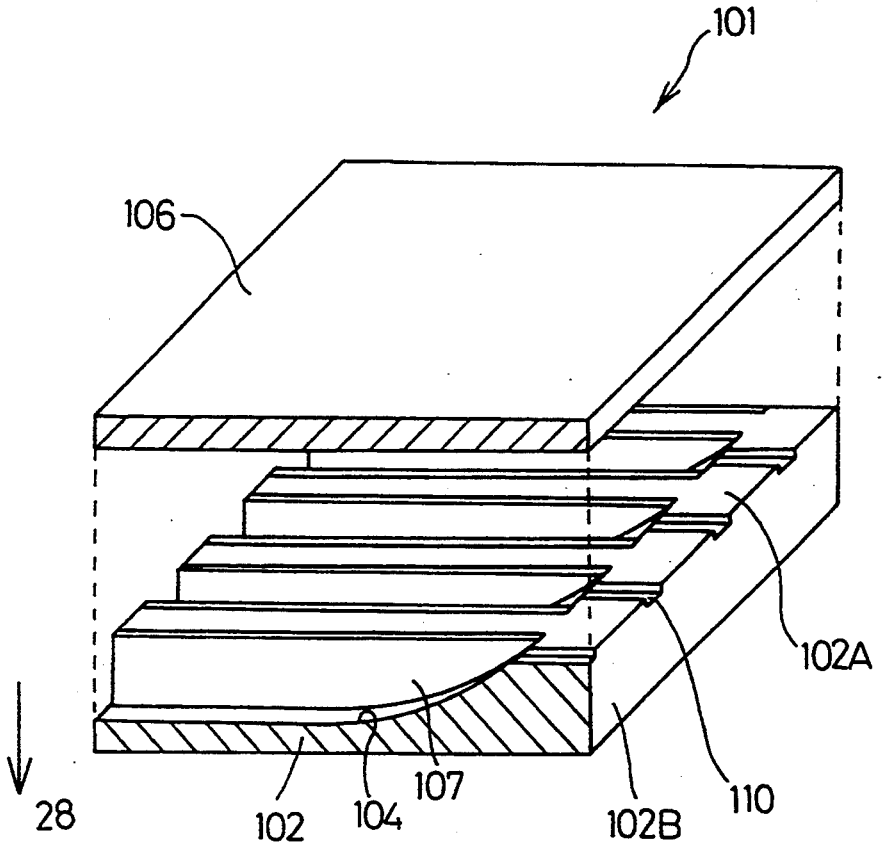
FIG. 9 is a perspective view illustrating a manufacturing method for an array constituting a part of a droplet jet device according to a fourth preferred embodiment of the invention.
Figure 10:
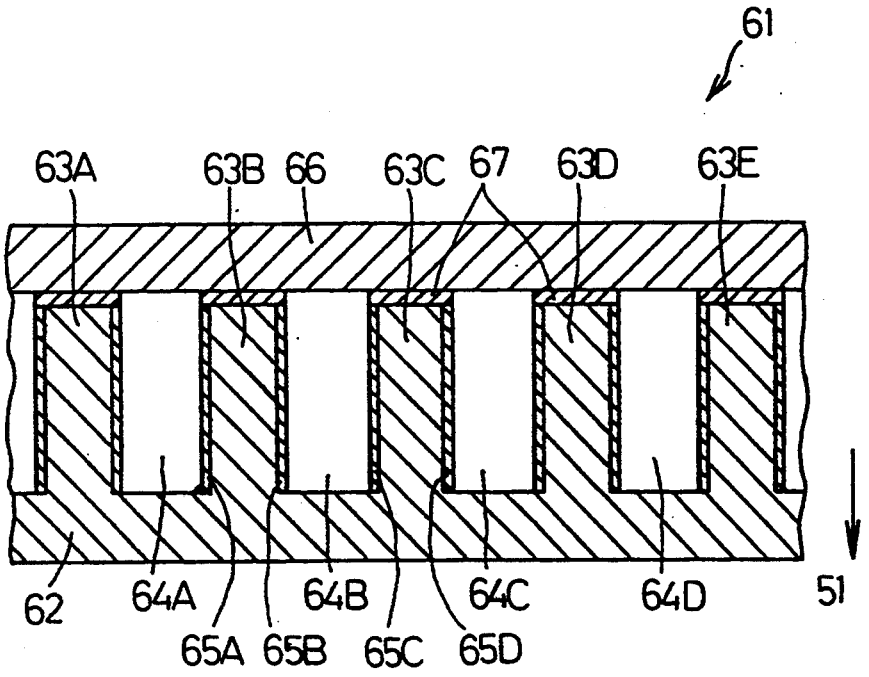
Fig.10 RELATED ART
FIG. 10 is a sectional view of an array constituting a part of a droplet jet device in the related art.

Referring to FIG. 8, a manufacturing method for a third preferred embodiment of the invention will be described. A piezoelectric ceramics plate 102 polarized in the direction of an arrow 28 is machined by grinding such as by rotation of a diamond cutting disk or by laser beam machining to form a plurality of first grooves 104 each constituting an ink channel and a plurality of second grooves 110 respectively continued to the first grooves 104. The second grooves 110 are formed on the ink jet side of the piezoelectric ceramics plate 102. The second grooves 110 have a depth smaller than that of the first grooves 104. In the case of grinding using the diamond cutting disk, the second grooves 110 can be easily formed by upwardly moving the diamond cutting disk near the end surface of the piezoelectric ceramics plate 102. In the case of laser beam machining, the second grooves 110 can be easily formed by reducing laser power near the end surface of the piezoelectric ceramics plate 102. A metal electrode 107 for applying a driving electric field to the piezoelectric transducer is formed on the surface of each first groove 104 by sputtering or the like. A cover plate 106 is bonded to an upper surface 102A of the piezoelectric ceramics plate 102 on the first and second grooves 104, 110 side.

In operation, when side walls 105A and 105B, for example, of the piezoelectric transducer are deformed by applying a driving electric field to the corresponding metal electrodes, a volume of the first groove 104 defined between the side walls 105A and 105B is changed, so that ink is jetted from the corresponding second groove 110.

The above-mentioned embodiment of FIG. 8 is not limitative, but various modifications may be made without departing from the scope of the invention. For example, referring to FIG. 9, a manufacturing method for a fourth preferred embodiment of the invention will be described, in which the same or corresponding parts as found in FIG. 8 are denoted by the same reference numerals for the convenience of explanation.

A piezoelectric ceramics plate 102 polarized in the direction of an arrow 28 is machined by grinding such as by rotation of a diamond cutting disk or by laser beam machining to form a plurality of first grooves 104 each constituting an ink channel. The first grooves 104 are so formed as to not reach an end surface 102B of the piezoelectric ceramics plate 102 on the ink jet side. A plurality of second grooves 110 are formed to continue from the first grooves 104 so as to reach the end surface 102B. The second grooves 110 have a sectional area smaller than that of the first grooves 104. A metal electrode 107 for applying a driving electric field to the piezoelectric transducer is formed on the surface of each first groove 104 by sputtering or the like. A cover plate 106 is bonded to an upper surface 102A of the piezoelectric ceramics plate 102 on the side of the first and second grooves 104, 110.

Again, in the droplet jet device of the third and the fourth preferred embodiments as mentioned above, it is not necessary to bond a nozzle plate to the end surface of the piezoelectric ceramics plate on the ink jet side thereby reducing the number of parts and manufacturing steps and accordingly reducing manufacturing costs. Further, as no step of bonding the nozzle plate is required, the associated temperature increase of the piezoelectric transducer and the deterioration in piezoelectric characteristics of the elements due to the temperature increase is avoided.

Although the formation of the ink channels is effected by bonding the cover plate 106 to the piezoelectric ceramics plate 102 in the above preferred embodiments, it may be effected by bonding two piezoelectric ceramics plates having the same shape.

What is claimed is:

1. A droplet jet device having a plurality of jet units for jetting ink, comprising:

a piezoelectric ceramics plate having a nozzle end surface;

at least one piezoelectric transducer formed by at least one pair of side walls on said piezoelectric ceramics plate, said pair of side walls defining an ink channel having one end spaced from the nozzle end surface of said piezoelectric ceramics plate;

electrodes formed on said side walls;

a cover plate mounted on said side walls, said cover plate having a jet channel; and a jet nozzle opening formed on said cover plate at an end of said jet channel, said jet channel communicating with said ink channel at an opposite end of said jet channel, wherein a bottom surface of the ink channel slopes gradually toward said jet nozzle and said jet nozzle opening has a sectional area smaller than a sectional area of said ink channel.

2. The droplet jet device as claimed in claim 1, further comprising displacement means for displacing said cover plate to sever communication between said ink channel and said jet channel.

3. The droplet ink jet device as claimed in claim 2, wherein said displacement means comprises moving means for displacing said cover plate; and return means for returning said cover plate to an operating position during print operations.

4. The droplet jet device as claimed in claim 1, further comprising a driving means for applying a voltage to said electrodes.

5. The droplet jet device as claimed in claim 1, wherein said at least one pair of spaced apart side walls are a part of said piezoelectric ceramics plate.

6. The droplet jet device as claimed in claim 1, wherein said piezoelectric ceramics plate has a groove that comprises said ink channel.

7. A droplet jet device having a plurality of jet units for jetting ink, comprising:

a piezoelectric ceramics plate having a nozzle end surface, said piezoelectric ceramics plate formed with a plurality of spaced apart side walls therein defining a plurality of ink channels, each of said ink channels having one end spaced from the nozzle end surface;

a cover plate mounted on said piezoelectric ceramics plate and formed with a plurality of jet nozzles respectively communicating with said ink channels of said piezoelectric ceramics plate;

a pair of electrodes provided in each said ink channel of said piezoelectric ceramics plate; and a driving means for applying voltage to said electrodes, wherein each said jet nozzle has a sectional area smaller than a sectional area of each said ink channel and a bottom surface of each ink of said channels slopes gradually toward an associated jet nozzle.

8. The droplet jet device as claimed in claim 7, wherein said cover plate is bonded on said piezoelectric ceramics plate by an adhesive material.

9. The droplet jet device as claimed in claim 7, wherein said cover plate is movably mounted on said piezoelectric ceramics plate between an operating position at which each of said jet nozzle is communicated a respective one of said ink channels, and a rest position at which each said jet nozzles is not communicated with the respective one of said ink channels to prevent contact of ink with outside air.

10. The droplet jet device as claimed in claim 9, further comprising moving means for moving said cover plate between said operating position and said rest position.

11. The droplet jet device of claim 7, further comprising electrodes formed on the spaced apart side walls of said ink channels.

* * * * *